United States Patent [19]

Sykes et al.

[11] Patent Number: 4,555,329

[45] Date of Patent: Nov. 26, 1985

[54] SELECTIVE FLOCCULATION OF COAL

[75] Inventors: Robert C. Sykes, Greenville, S.C.; Lawrence J. Connelly, Oak Lawn; William J. Roe, Aurora, both of Ill.

[73] Assignee: Nalco Chemical Company, Oak Brook, Ill.

[21] Appl. No.: 679,728

[22] Filed: Dec. 10, 1984

[51] Int. Cl.[4] ..... B03D 3/06

[52] U.S. Cl. ..... 209/5

[58] Field of Search ..... 209/4, 5; 210/727, 733, 210/734

[56] References Cited

U.S. PATENT DOCUMENTS

| | | | |
|---|---|---|---|
| 3,055,827 | 9/1962 | Wileg | 210/727 |
| 3,408,293 | 10/1968 | Dajani et al. | 210/727 |
| 4,210,531 | 7/1980 | Wang et al. | 210/727 |

OTHER PUBLICATIONS

Symposium on Water Soluble Polymers, Bad Nauheim, West Germany 4/84—Dr. Hartan Chemische Fabrik Stockhausen.

*Primary Examiner*—Bernard Nozick

*Attorney, Agent, or Firm*—John G. Premo; Donald G. Epple

[57] ABSTRACT

A method for separating inorganic gangues from coal particulates dispersed in a coal refuse slurry comprises the selective flocculation of the coal refuse slurry by initially adding an anionic dispersant followed subsequently by adding an anionic flocculant, allowing the flocculating coal slurry obtained to settle and collecting a concentrated settled coal slurry having a lowered ash value. The dispersed inorganic gangues may be recovered by the addition of a cationic flocculant/coagulant with subsequent recycle of the aqueous phase.

5 Claims, 1 Drawing Figure

POLYMER A DOSAGE VS % ASH IN UNDERFLOW

POLYMER A DOSAGE VS % ASH IN UNDERFLOW

SELECTIVE FLOCCULATION OF COAL

INTRODUCTION

Figure 1:
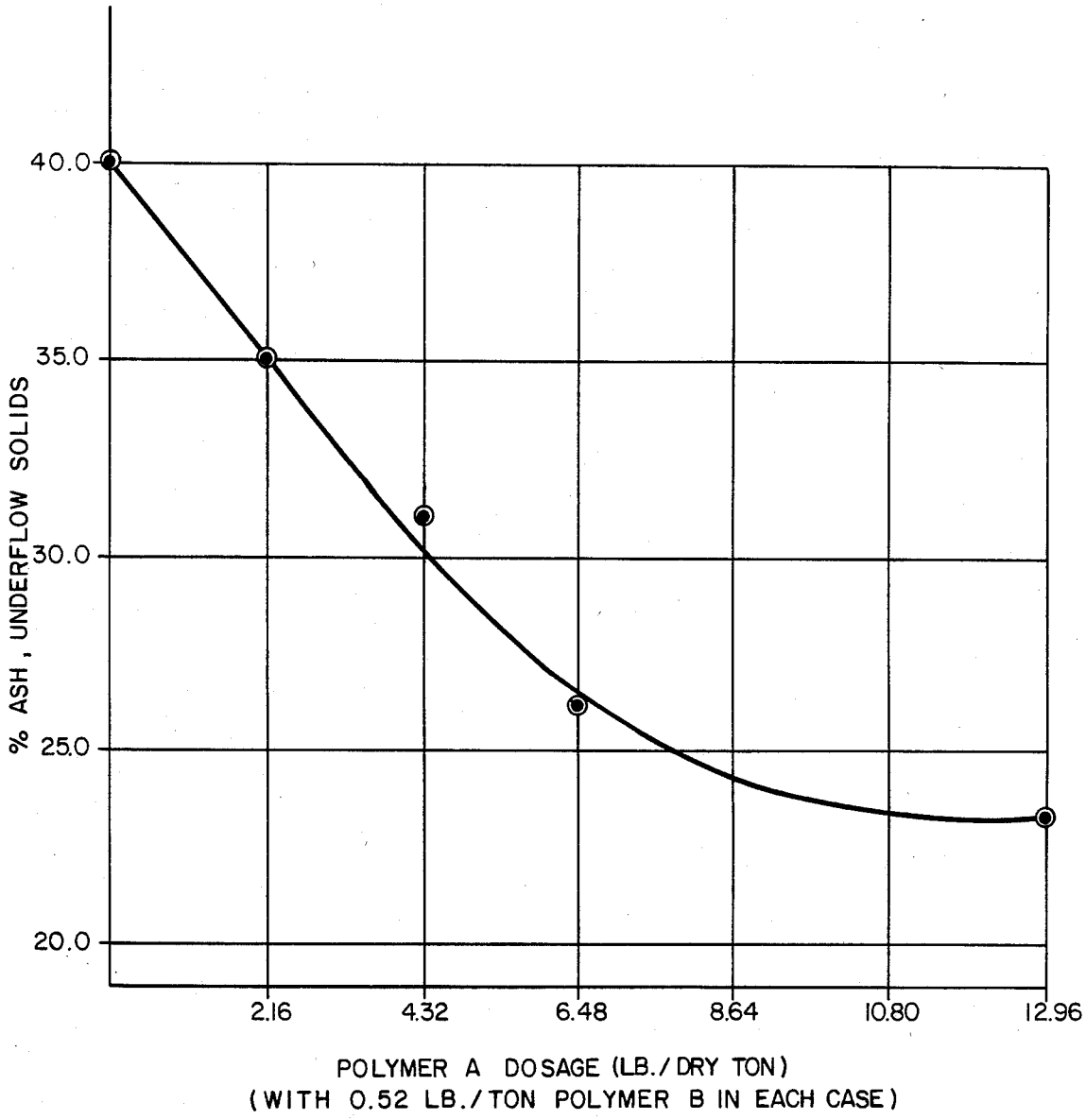

Typical coal refuse thickener feed to a settling tank contains considerable amounts of inorganic gangue, clays and the like. These materials have previously been pulverized and dispersed in water and present a difficult problem in regards to the recovery of coal values therefrom. In most instances, no attempt is even made to recover the coal in the refuse or reject. As a result, the coal is lost. The coal content in the refuse can range from about 25 to 70% (based on the weight of refuse solids). Simply adding flocculants to this slurry provides flocculation for both coal particulate matter as well as the particulate matter obtained from inorganic gangue, clays and other suspended materials present in these slurries, such that separation of the coal values is not possible.

If it would be possible to selectively flocculate the coal values from such a pulverized coal refuse slurry, an advance in the art could be achieved.

We have discovered that we can selectively flocculate coal from such a pulverized coal refuse aqueous slurry by first adding dispersant chemicals to such an admixture followed by the addition of flocculants which then cause the selective flocculation and settling of coal particles while leaving inorganic gangue, clays and like materials preferentially suspended in the aqueous phase.

Applying standard solid/liquid separation techniques to this selectively flocculated coal then provides for the recovery of a concentrated, flocculated coal slurry whose ash value is appreciably lower than the original coal refuse ash value and provides for the recovery of dispersed clays, inorganic gangues, and the like with recycle of waters possible which may derive additional economic benefit to the operator.

It is the object of this invention to selectively flocculate coal values from a dispersed pulverized coal refuse slurry which contains both pulverized coal and inorganic gangue, clays and the like, by first adding a dispersant, subsequently adding a flocculant, and then collecting a flocculated coal having lower ash values. A clay like inorganic gangue material dispersed in water may then be subsequently settled and collected, and the water values recycled back to the mining operations.

It is also an object of this invention to recover a low ash particulate coal from a pulverized coal refuse slurry containing high ash inorganic gangues, clays and the like.

THE INVENTION

We have discovered a method of selectively flocculating a pulverized coal refuse containing both inorganic gangues and coal particulates, thereby providing for removal of inorganic gangue from coal particulates and decreasing the percent ash in the recovered coal, which method comprises sequentially treating an aqueous dispersion or slurry of pulverized coal refuse with an initial and effective amount of an anionic polyacrylate dispersant having a molecular weight in the range of about 2,000–200,000, and then adding an effective amount of an anionic vinyl polymeric flocculant having a molecular weight ranging between about 1,000,000–50,000,000, then allowing sufficient time for settling and flocculation of coal particulates to occur, and then after the settling and flocculation, collecting a selectively flocculated coal particulate slurry having a decreased ash content.

Our method of separating gangue from coal in a pulverized coal refuse slurry comprises the selective flocculation of a coal refuse slurry by:

a. adding thereto an effective amount of an anionic vinyl polymeric dispersant having a molecular weight ranging between about 2,000–200,000, thereby forming a dispersed coal refuse slurry, and then
b. adding thereto an effective amount of an anionic vinyl polymeric flocculant having a molecular weight ranging between about 1,000,000 and about 50,000,000, thereby forming a flocculating coal slurry, and
c. allowing the flocculating coal slurry to settle without vigorous agitation, thereby forming a concentrated, settled coal slurry and a dispersed inorganic gangue slurry, and then
d. collecting the concentrated settled coal slurry and removing water and dissolved salts therefrom to obtain a low-ash coal particulate, while separately
e. treating said dispersed inorganic gangue with a cationic flocculant/coagulant to form a flocculated inorganic gangue and a recyclable aqueous phase and finally
f. collecting the flocculated inorganic gangue and recycling the aqueous phase.

ANIONIC DISPERSANTS

The method for selectively flocculating the pulverized coal refuse slurries uses the following types of dispersants. Preferably an anionic vinyl polymeric dispersant is used which is chosen from the group consisting of homopolymers of acrylic acid, homopolymers of methacrylic acid, copolymers of acrylic acid with monomers such as acrylamide, vinyl sulfonate, methacrylic acid, ethylacrylate, methylacrylate, maleic anhydride, and mixtures thereof. In addition these anionic vinyl polymeric dispersants may be copolymers of methacrylic acid with acrylamides, vinyl sulfonate, ethylacrylate, methylacrylate, maleic anhydride, and mixtures thereof. The dispersants may have a weight average molecular weight of from 2,000–200,000 and preferably the anionic vinyl polymeric dispersants have a weight average molecular weight between about 5,000–50,000. These anionic vinyl polymeric dispersants are preferably either homopolymers of acrylic acid or methacrylic acid or are copolymers of acrylic acid with acrylamide, methacrylic acid, ethylacrylate, methylacrylate, vinyl sulfonate and mixtures of these monomers. The anionic vinyl polymeric dispersants preferably contain at least 50 mole percent of a carboxylic acid containing monomer such as acrylic acid or methyacrylic acid. Preferably these dispersants contain at least 80 mole percent of a carboxylic acid containing monomer such as acrylic acid or methacrylic acid. These materials may be used in all pH ranges, however neutral and basic pH ranges are preferred. It is understood that reference to a monomer in a free acid form should include its water soluble salts as well.

The anionic vinyl polymeric dispersant is most preferably a homopolymer of acrylic acid or a copolymer of acrylic acid and methyacrylic acid. Either the homopolymer or the copolymer mentioned above should have a weight average molecular weight ranging between about 5,000 and 50,000 and is added to the pulverized coal refuse slurry containing both inorganic gangues clays and the like as well as particulated coal at a dispersant concentration of between about 10–500 parts per million by weight (ppmw). Preferably the treatment level of these anionic polymeric dispersants is between about 15 to 250 ppmw based on the total weight of the slurry being treated

THE FLOCCULANT POLYMERS

After the polymeric dispersants are added and admixed with the pulverized coal refuse slurries, the anionic vinyl polymeric flocculants may then be added. These anionic vinyl polymeric flocculants are normally polymers of acrylamide with acrylic acid, methacrylic acid, vinyl sulfonate, maleic anhydride, or mixtures thereof. These acrylamide based anionic polymers normally have a weight average molecular weight between about 1,000,000 and about 50,000,000, preferably they have a molecular weight between about 5,000,000 and about 25,000,000, and most preferably they have a molecular weight between about 5,000,000 and about 20,000,000.

The anionic vinyl polymeric flocculants normally are copolymers of acrylamide and acrylic acid wherein the weight ratio of acrylamide to acrylic acid ranges between about 20:1 to 1:20 and the molecular weight ranges between about 5,000,000 and about 25,000,000. The anionic vinyl polymeric flocculants may be added as aqueous solutions said aqueous solutions being formed by dissolving solid powdered flocculant or by dissolving a water-in-oil latex which contains such a flocculant and which has previously been described in the Frisque/Anderson U.S. Pat. Nos. Re. 28,474 and 28,576, both of which are incorporated herein by reference.

THE CATIONIC FLOCCULANT/COAGULANT

After separating the flocculated particulate coal from the dispersed inorganic gangue, clays and the like, the dispersed clays and gangue materials can be treated in a separate operation and precipitated from the dispersed slurries by adding thereto any kind of cationic flocculant and/or coagulant that may be available. This charge neutralization step is aimed at neutralizing the negative charge caused by the anionic dispersant absorbed on the surfaces of the inorganic clays gangues and the like materials in this inorganic gangue dispersion. This charge neutralization is often sufficient itself for precipitation and settling to occur. It is immaterial whether or not a high molecular weight cationic flocculant or a cationic coagulant having a lower molecular weight is used in this step. The step may be optimized at the experimenters choice.

The cationic flocculant/coagulant is normally chosen from the group consisting of polymers containing DADMAC, MAPTAC, DMAEA, DMAEM*, quaternized salts of DMAEA and/or DMAEM, and the like. The invention regarding the use of these cationic flocculants/coagulants is not to be limited to the vinyl monomers mentioned above but may include any cationic flocculant/coagulant which is synthesized using a vinylic monomer having a cationic nature or which could have a cationic nature if protinated with acid solutions or quaternized with standard quaternizing agents such as dimethyl sulfate, methyl chloride, methyl bromide, and the like.

*DADMAC=Diallyl dimethyl ammonium chloride MAPTAC=Methacrylamidopropyl trimethyl ammonium chloride DMAEA=Dimethyl aminoethyl acrylate and/or its acid salts DMAEM=Dimethylaminoethylmethacrylate The cationic flocculant/coagulant may also be chosen from the group consisting of cationic water-soluble or water dispersible condensation polymers which may be formed by condensation polymerization of materials such as epichlorohydrin-dimethylamine, ethylenedichloride-ammonia, ethylenedichloride-methylamine-ammonia, epichlorohydrin-dimethylamine-ethylene oxide-propylene oxide, aniline-formaldehyde reacted with materials such as epichlorohydrin dimethylamine condensated polymers, or any other cationic condensation polymers which contains epichlorohydrin, dimethylamine, ethylenedichloride, ammonia, methylamine, ethyleneoxide, propyleneoxide, aniline-formaldehyde condensates, or any admixture of the above ingredients, so as to form a cationic condensation polymer which is water soluble.

The cationic flocculant-coagulant may have a weight average molecular weight ranging between about 500–25,000,000. The cationic flocculant-coagulant is preferably chosen from a vinylic cationic polymer containing monomers having or modified to contain cationic charges and which have a weight average molecular weight ranging between about 5,000–10,000,000. The cationic flocculant-coagulant may include cationic surface active agents of relatively low molecular weight, such as, for example, ethylene oxide modified amines, and the like. When these kind of cationic surface active agents are used, the molecular weight may range between about 500–5,000.

The cationic flocculant-coagulant is normally added at a concentration ranging between about 0.5–50 ppm on the basis of total weight of the inorganic gangue disperson remaining after the particulate coal has been flocculated and separated therefrom.

Although it is preferred to add these cationic flocculant-coagulants to provide a rapid settling step for the inorganic gangue dispersions thereby allowing water recovery and recycling and recovery of this inorganic material, the invention can function to recover low-ash coals without the addition of this cationic flocculant-coagulant. Other means of recovering the inorganic gangue and recycling water can be anticipated by the person familiar with the art.

SOLIDS/LIQUID SEPARATION

Settling of concentrated slurries normally occurs in a clarifier. Clarifier operation is familiar to the artisan and usually involves feeding a suspension, dispersion, slurry or the like into a high volume, low agitation settling tank equipped with baffles, inlets for the feed, and outlets for both overflow and underflow, and other design parameters aimed at enhancing the concentration and removal of the settling phase. Once the underflow, or settling phase, has been removed, it may be washed, diluted further with additional liquid, then treated in a cyclic fashion in another clarifier, or may possibly be filtered, decanted, or subjected to other operations designed to separate and collect the flocculated solids.

As herein described, the coal refuse slurries can contain from about 3 to about 20 weight percent solids, but normally these slurries contain between about 5 to 15% dispersed solids. These solids are from about 30–75% inorganic gangue which would be responsible for a high ash residue if these materials were burned without treatment. If the ash values could be lowered to about 20% or less, the coal could be of improved commercial value.

The slurries can be treated as is or they may be either concentrated or diluted before treatment using the techniques described herein. Preferably, the slurries being treated contain from about 2.5–10 weight % solids.

To better define the invention as we have described it, the following examples are presented

EXAMPLE I

A sample of pulverized coal refuse slurry containing 14.8% total solids were obtained from a coal mine in the central United States. This coal refuse feed was diluted with water to contain about 4.9% total solids. One thousand grams of the diluted slurry was placed in each of five graduated cylinders for testing. Various amounts of dispersant and flocculant were added to these cylinders whereupon the cylinders were inverted six times for mixing purposes after the addition of the dispersant, and following the addition of the flocculant were inverted four more times for mixing purposes prior to settling rates being measured.

After five minutes of settling time, the supernatant liquid was drawn off down to the solid-liquid innerface using a vacuum suction apparatus. The underflow solids which remained were redispersed in tap water to the original volume and allowed to resettle for an additional five-ten minutes. The wash water was drawn off and retained as well.

The underflow solids, that is the flocculated coal samples, were dried at 105° C. to constant weight. Samples of the original supernatant, the wash water, and the overflow solids were submitted for analysis to determine percent ash and/or percent suspended solids. The results are presented in Table I.

TABLE I

| DISPERSANT FLOCCULANT | DOSAGE (#/DRY TON) | SETTLING RATE (FT/HR) | Test Results % SS SUPERNATANT | % ASH SUPERNATANT | % SS WASH $H_2O$ | % ASH WASH $H_2O$ | % ASH UNDERFLOW |
|---|---|---|---|---|---|---|---|
| B | 0.52 | 20.0 | 0.02 | 67.15 | 0.10 | 25.50 | 40.37 |
| A/B | 2.16/0.52 | very fast | 0.67 | 83.42 | 0.02 | 40.21 | 35.13 |
| A/B | 4.32/0.52 | very fast | 0.83 | 74.98 | 0.04 | 55.36 | 31.12 |
| A/B | 6.48/0.52 | very fast | 2.36 | 51.03 | 0.06 | 67.99 | 26.10 |
| A/B | 12/96/0.52 | very fast | 2.62 | 53.98 | 0.08 | 56.49 | 23.47 |

where A = anionic dispersant-a copolymer of methacrylic acid/acrylic acid; weight ratio MAA:AA = 1:4, MW = 2, 500–50,000.
B = anionic flocculant-copolymer of acrylic acid-acrylamide; acrylate/amide monomer weight ratio = 1:5

As can be seen from the results of Table I the use of the dispersant plus flocculant readily decreases the percent ash in the underflow, settled and flocculated coal from this process. The percent ash of the starting pulverized coal refuse is 40.4% whereas the percent ash in the settled flocculated coal using optimum conditions ranges in the 25±2% range. This is a dramatic 40% reduction in total ash.

A DESCRIPTION OF THE DRAWING

FIG. 1 presents a graphical display of the data presented in Table I.

The results of this dramatic reduction in percent ash in the recovered flocculated coal is presented relative to the dosage of polymer A in terms of pounds per dry ton in the presence of a constant supply of polymer B. FIG. 1 therefore graphically represents the 40% reduction in total ash when the combined polymers of this invention are used as described. A 40% reduction in ash as recovered in underflow solids is observed when the dosage of polymer A is increased with a constant adddition rate of polymer B.

EXAMPLE II

Tests were conducted to separate coal values from the gangue solids occurring in flotation cells and in the flotation tails from coal preparation plants operating in the central states. This central state mine operation was considerably removed from the location of the first test and the coal seam being operated had different characteristics. In addition, dispersion of the inorganic gangue and clay mineral materials was attempted with another dispersant which contained 100 mole percent acrylic acid and had a molecular weight ranging between about 2,500–25,000. The studies were conducted in a pilot scale Enviro-clear thickener in order to better determine the effectiveness of the reagents used under conditions simulating a constant feed of slurry and constant removal of separated flocculated coal solids. A simple one step process using this particular dispersant was not successful in achieving reduction in the ash obtained from a underflow flocculated coal material.

However, additional tests were run using the same combination of this new dispersant with the same flocculant as used in Example I above. This second series of tests added 25 ppm of dispersant, based on the weight of the initial slurry, to the pulverized coal refuse slurry entering the pilot unit. To this dispersed coal slurry was added 1.0 ppm of the same flocculant used in Example I. After settling had occurred and continuously thereafter the flocculated coal slurry underflow was removed from the pilot unit. This underflow was diluted to the original solids level (about 3.4%) with tap water and treated again with another 25 ppm of the polyacrylic acid dispersant. This was recycled into the pilot settling unit followed by additional addition of the flocculant polymer at 1 ppm by weight, such that the total sample was treated three times using this recycling procedure, with repulping of the underflow occurring in between each treatment step using clean water. Using this recycling method, the results again showed that the percent ash in the underflow flocculated coal could be removed from an original level of about 28% to a level of about 20±1%. This data is presented in Table II below.

TABLE II

EFFECT OF MULTIPLE-STAGE SELECTIVE SEPARATIONS

| Number of Treatment Stages | Poly C Dosage (ppm) | Poly B Dosage (ppm) | Overflow Suspended Solids (ppm) | Underflow % Ash |
|---|---|---|---|---|
| 1 | 25 | 1.0 | 660 | 27.80 |
| 2 | 25/25 | 1.0/1.0 | 2980 | 29.64 |
| 3 | 25/25/25 | 1.0/1.0/1.0 | 6860 | 20.64 |

Polymer B = see above
Polymer C = homopolymer of acrylic acid, MW = 5,000–25,000

Although the percent ash reduction is not as dramatic in this situation, one can see by examining the results in Table II that the total percent ash in the flocculated coal is reduced on the order of about 30%.

The remaining gangue dispersion would be expected to be settled by the addition of a cationic flocculant or coagulant. This flocculant could be, for example, a cationic polymer, having a molecular weight of 5,000–25,000,000, such as a copolymer of acrylamide with diallyl dimethyl ammonium chloride as a monomer weight ratio of between 10:1 to 1:10. Treatment of this dispersed gangue slurry with from 0.5–10 ppm of this type of cationic polymeric would be expected to rapidly settle the inorganic gangue, clays, et. al. from this slurry. For example, if 1,000 grams of overflow from either Example 1 or 2 above were added to a graduated cylinder, and 5 ppm of a cationic polymer having a molecular weight between about 5,000–25,000,000 and comprising 50 weight % acrylamide and 50 weight % DADMAC were added thereto, followed by inversion of the cylinder about 4–6 times for mixing purposes, when the cylinders were placed quietly on a flat surface, the dispersion so treated would be expected to separate into water clear overflow and concentrated underflow phases within 5 minutes. The water clear phase would be of sufficient quality to be recycled for use in continuous minimg procedures.

Having described our invention, we claim:

1. A method of separating gangue from coal in a coal refuse slurry which comprises the selective flocculation of a coal refuse slurry by:

a. adding thereto an effective amount of an anionic vinyl polymeric dispersant having a molecular weight ranging between about 2,000–250,000, thereby forming a dispersed coal refuse slurry, and then, b. adding thereto an effective amount of an anionic vinyl polymeric flocculant having a molecular weight ranging between about 1,000,000 and about 50,000,000, thereby forming a flocculating coal slurry, c. allowing the flocculating coal slurry to settle without vigorous agitation, thereby forming a concentrated, settled coal slurry and a dispersed gangue slurry, and then d. collecting the concentrated, settled coal slurry and removing water and dissolved salts therefrom to obtain a low-ash coal particulate, while separating e. treating said dispersed gangue with a cationic flocculant or coagulant to form a flocculated and settled inorganic gangue and a recyclable aqueous phase, and finally f. collecting the flocculated inorganic gangue and recycling the aqueous phase.

2. The method of claim 1 wherein:

a. the anionic vinyl-polymeric dispersant is from the group consisting of homopolymers of acrylic acid or methacrylic acid and copolymers of acrylic acid with acrylamides, vinyl sulfonate, methacrylic acid, ethyl acrylate, methyl acrylate, maleic anhydride, and mixtures thereof, and has a molecular weight between about 5,000–50,000 b. the anionic vinyl polymeric flocculant is a polymer of acrylamide with acrylic acid, methacrylic acid, vinyl sulfonate, maleic anhydride and mixtures thereof and has a molecular weight between about 5,000,000 to 35,000,000 and c. the cationic flocculant/coagulant is from the group consisting of homopolymers of DADMAC, MAPTAC, DMAEA, DMAEM monomers; copolymers of any of these monomers with acrylamide, a cationic condensation polymer containing EPI-DMA, EDC, $NH_3$, Methyl amine, EO, PO, aniline formaldehyde or any admixture of the above, and said cationic flocculant/coagulant has a molecular weight ranging between about 5,000–15,000,000.

3. The method of claim 2 wherein:

a. the anionic vinyl polymeric dispersant is a homopolymer of acrylic acid or a copolymer of acrylic acid and methacrylic acid having a molecular weight between about 5,000–50,000 and is added to the coal refuse slurry at a concentration of between 10–500 ppmw, b. the anionic vinyl polymeric flocculant is a copolymer of acrylamide and acrylic acid, wherein the weight ratio of acrylamide to acrylic acid is from 20:1 to 1:20, the molecular weight is between about 5,000,000–25,000,000, and the flocculant is added to the dispersed coal refuse slurry at a concentration ranging between about 0.2–10.0 ppmw, and c. the cationic flocculant/coagulant has a molecular weight ranging between about 5,000–1,000,000 and is added to the dispersed gangue at a concentration ranging between about 0.5–25 ppmw.

4. A method of selectively flocculating aqueous pulverized coal refuse slurries containing particulate coal in the presence of inorganic gangues and clays which comprises:

a. treating the aqueous coal refuse slurries with from 10–250 ppmw of an anionic polymeric water-soluble dispersant chosen from homopolymers and copolymers of acrylic acid, methacrylic acid, acrylamide, and vinyl sulfonate, and having a molecular weight between 2,000–200,000, and then b. adding thereto from 0.2–10 ppmw of an anionic vinyl polymeric flocculant chosen from homopolymers or copolymers of acrylamide, acrylic acid, methacrylic acid, vinyl sulfonic acid, and the like, which polymers have a molecular weight between about 1,000,000–35,000,000, and then c. separating a flocculated coal having a low ash content from the inorganic gangue and clays.

5. The method of claim 4 wherein:

a. the anionic polymeric dispersant is added at from 20–100 ppmw and is a homopolymer of acrylic acid or a copolymer of acrylic acid with acrylamide methacrylic acid, methylacrylate, ethyl acrylate, or mixtures thereof, and which has a molecular weight between about 5,000–50,000, and b. the anionic polymeric flocculant is added at from 1–10 ppmw and is a copolymer of acrylic acid and acrylamide, and has a weight ratio of acrylic acid:acrylamide of from 20:1 to 1:1 and a molecular weight between 5,000,000–25,000,000.

* * * * *